US011517051B2

(12) United States Patent
Hoffman

(10) Patent No.: US 11,517,051 B2
(45) Date of Patent: Dec. 6, 2022

(54) ELECTRONIC SMOKING DEVICE WITH SELF-HEATING COMPENSATION

(71) Applicant: Fontem Holdings 1 B.V., Amsterdam (NL)

(72) Inventor: Adam Hoffman, San Jose, CA (US)

(73) Assignee: Fontem Ventures B.V., Amsterdam (NL)

( * ) Notice: Subject to any disclaimer, the term of this patent is extended or adjusted under 35 U.S.C. 154(b) by 548 days.

(21) Appl. No.: 16/135,955

(22) Filed: Sep. 19, 2018

(65) Prior Publication Data

US 2020/0085100 A1 Mar. 19, 2020

(51) Int. Cl.

| | |
|---|---|
| ***A24F 40/50*** | (2020.01) |
| ***A24F 40/51*** | (2020.01) |
| ***A24F 40/80*** | (2020.01) |
| ***A24F 40/53*** | (2020.01) |
| ***A24F 40/57*** | (2020.01) |
| ***H05B 3/00*** | (2006.01) |

(52) U.S. Cl.

CPC ..... *A24F 40/50* (2020.01); *A24F 40/51* (2020.01); *A24F 40/53* (2020.01); *A24F 40/57* (2020.01); *A24F 40/80* (2020.01); *H05B 3/0014* (2013.01)

(58) Field of Classification Search

CPC .... G06F 17/00; G06F 1711/00; A24F 47/008; A24F 47/002; A24F 47/004; A24F 40/53; A24F 40/50; A24F 40/51; A61M 11/00; A61M 15/06; H05B 3/0014

See application file for complete search history.

(56) References Cited

U.S. PATENT DOCUMENTS

| | | | | |
|---|---|---|---|---|
| 9,427,022 | B2 | 8/2016 | Levin et al. | |
| 2015/0122274 | A1 | 5/2015 | Cohen et al. | |
| 2015/0237917 | A1* | 8/2015 | Lord | G01K 1/20 131/328 |
| 2015/0359263 | A1 | 12/2015 | Bellinger | |
| 2016/0021930 | A1 | 1/2016 | Minskoff et al. | |
| 2016/0232466 | A1 | 8/2016 | Lord et al. | |
| 2017/0042240 | A1 | 2/2017 | Murison | |
| 2018/0020728 | A1 | 1/2018 | Alarcon | |

FOREIGN PATENT DOCUMENTS

| | | | |
|---|---|---|---|
| GB | 2542011 | A | 3/2013 |
| WO | 2014205263 | A1 | 12/2014 |

* cited by examiner

*Primary Examiner* — Michael J Felton

(74) *Attorney, Agent, or Firm* — Dykema Gossett PLLC

(57) ABSTRACT

Various aspects of the present disclosure are directed to electronic cigarette temperature compensation.

5 Claims, 3 Drawing Sheets

ELECTRONIC SMOKING DEVICE WITH SELF-HEATING COMPENSATION

FIELD OF INVENTION

The present invention relates generally to electronic smoking devices and in particular electronic cigarettes.

BACKGROUND OF THE INVENTION

An electronic smoking device, such as an electronic cigarette (e-cigarette or e-cig), typically has a housing accommodating an electric power source (e.g., a single use or rechargeable battery, electrical plug, or other power source), and an electrically operable atomizer. The atomizer vaporizes or atomizes liquid supplied from a reservoir and provides vaporized or atomized liquid as an aerosol. Control electronics control the activation of the atomizer. In some electronic cigarettes, an airflow sensor is provided within the electronic smoking device, which detects a user puffing on the device (e.g., by sensing an under-pressure or an air flow pattern through the device). The airflow sensor indicates or signals the puff to the control electronics to power up the device and generate vapor. In other e-cigarettes, a switch is used to power up the e-cigarette to generate a puff of vapor.

SUMMARY OF THE INVENTION

Aspects of the present disclosure are directed to electronic cigarette temperature compensation.

One embodiment of the present disclosure is directed to an electronic smoking device including an airflow sensor, a temperature sensor, and control electronics. The airflow sensor senses airflow through the electronic smoking device and outputs a first signal indicative of the sensed airflow. The temperature sensor senses a temperature and outputs a second signal indicative of the sensed temperature. The control electronics are communicatively coupled to the airflow sensor and the temperature sensor. The control electronics receive the first and second signals, and based on the received second signal compensate for a temperature-induced airflow sensor signal error of the first signal. The control electronics operate the electronic smoking device based on the compensated first signal, which is indicative of the true airflow through the electronic smoking device.

In more specific embodiments, the electronic smoking device may further include a central passage that facilitates airflow through the electronic smoking device, a liquid reservoir that stores e-cigarette liquid, a heating coil communicatively coupled with the control electronics and positioned within the central passage, and a wick placed in fluid communication between the liquid reservoir and the heating coil. The wick draws the e-cigarette liquid within the liquid reservoir to the heating coil via capillary action. The control electronics, in response to the compensated first signal being indicative of the airflow through the electronic smoking device, drive the heating coil with a current that causes the e-cigarette liquid on the heating coil to vaporize into the airflow. Further, the control electronics maintain a constant density of vapor per unit volume of airflow in response to a change in the volumetric flow rate by varying the current to the heating coil based on the compensated first signal.

In some embodiments of the electronic smoking device, the second signal is indicative of an ambient temperature around the electronic smoking device. The control electronics associate the second signal from the temperature sensor with the ambient temperature when a standby time of the electronic smoking device exceeds a threshold time; and where the sensed ambient temperature is elevated, corrects the base-line signal of the first signal to compensate for the temperature-induced, base-line signal error associated with the elevated ambient temperature.

An electronic smoking device, consistent with the present disclosure, senses a temperature of the electronic smoking device via a temperature sensor. When the sensed temperature is elevated, the elevated temperature of the electronic smoking device may be associated with an elevated temperature of the electronic smoking device due to operation thereof. Control electronics of the electronic smoking device receive a second signal from the temperature sensor indicative of the (elevated) temperature of the electronic smoking device, and associates the temperature with an elevated temperature of the electronic smoking device when a standby time of the electronic smoking device is less than a threshold time; and in response to the elevated temperature, corrects the base-line signal of the first signal to compensate for the temperature-induced, base-line signal error associated with the elevated electronic smoking device temperature.

Aspects of the present disclosure are directed to an electronic smoking device, wherein the airflow sensor is a membrane-type mass airflow sensor including a first thin film temperature sensor, a second thin film temperature sensor, and a heater. The first thin film temperature sensor is printed on an upstream side of the mass airflow sensor. The second thin film temperature sensor is printed on a downstream side of the mass airflow sensor. The heater is positioned between the first and the second thin film temperature sensors. The heater maintains a constant mass airflow sensor temperature. The airflow sensor, without any airflow, produces a temperature profile across the sensor membrane that is substantially uniform, indicating no airflow across the sensor membrane. When air flows across the sensor, the first thin film temperature sensor cools more than the second thin film temperature sensor which is downstream of the heater, the extent of the temperature differential is indicative of the airflow velocity across the sensor membrane.

In some embodiments of the electronic smoking device of claim 1, the control electronics compensate for the temperature-induced, base-line signal error of the first signal using the following equation:

$$\text{Compensated First Signal}=(\text{Actual First Signal})*((1-\text{Calibration Coefficient})*(T_{Airflow\ Sensor}-T_{Ambient}))-\text{Ambient Coefficient}*|T_{Ambient}-T_{Calibration}|,$$

where $T_{Ambient}$, $T_{Calibration}$, Calibration Coefficient, and Ambient Coefficient are known, and $T_{Airflow\ Sensor}$ is determined based on the received second signal.

Various embodiments of the present disclosure are directed to an electronic smoking device including an airflow sensor, first and second temperature sensors, and control electronics. The airflow sensor senses airflow through the electronic smoking device and outputs a first signal indicative of the sensed airflow. The first temperature sensor senses an ambient temperature and outputs a second signal indicative of the sensed ambient temperature. The second temperature sensor senses an internal temperature of the electronic smoking device and outputs a third signal indicative of the sensed internal temperature. The control electronics are communicatively coupled to the airflow sensor and the first and second temperature sensors. The control electronics receive the first, second, and third signals, and based on the received second and third signals, determine the difference in temperature between the ambient temperature and the internal temperature of the electronic smoking device. The control electronics further, based on the difference in temperature, compensate for a temperature-induced airflow sensor signal error of the first signal from the airflow sensor, and operate the electronic smoking device based on the compensated first signal indicative of the true airflow through the electronic smoking device.

In some specific embodiments of the present disclosure, the control electronics associate a second signal from the first temperature sensor with an elevated ambient temperature when the second signal is indicative of an ambient temperature exceeding a threshold ambient temperature. When the sensed ambient temperature is elevated, the control electronics correct the base-line signal of the first signal to compensate for the temperature-induced, base-line signal error associated with the elevated ambient temperature.

In yet further embodiments of the present disclosure, the control electronics associate a third signal from a second temperature sensor with the elevated temperature of the electronic smoking device when the third signal is indicative of an internal temperature of the electronic smoking device which exceeds a threshold temperature. The control electronics, in response to the elevated temperature of the electronic smoking device, correct the base-line signal of the first signal to compensate for the temperature-induced, base-line signal error associated with the elevated electronic smoking device temperature.

The control electronics, consistent with the present disclosure, may compensate for the temperature-induced, base-line signal error of the first signal using the following equation:

$$\text{Compensated First Signal}=(\text{Actual First Signal})*((1-\text{Calibration Coefficient})*(T_{Airflow\ Sensor}-T_{Ambient}))-\text{Ambient Coefficient}*|T_{Ambient}-T_{Calibration}|,$$

where $T_{Calibration}$, Calibration Coefficient, and Ambient Coefficient are known, $T_{Airflow\ Sensor}$ is determined based on the received third signal, and $T_{Ambient}$ is determined based on the received second signal.

In other embodiments, the control electronics may compensate for the temperature-induced, base-line signal error of the first signal using the following equation:

$$\text{Compensated First Signal}=(\text{Actual First Signal})*((1-\text{Calibration Coefficient})*(T_{Airflow\ Sensor}-T_{Ambient}))-\text{Ambient Coefficient}*|T_{Ambient}-T_{Calibration}|^2,$$

where $T_{Calibration}$, Calibration Coefficient, and Ambient Coefficient are known, $T_{Airflow\ Sensor}$ is determined based on the received second signal, and $T_{Ambient}$ is determined based on the received second signal.

Other embodiments, consistent with the present disclosure, are directed to an electronic smoking device including an airflow sensor, and control electronics. Aspects of the present disclosure do not require temperature sensors to facilitate the identification of temperature-induced signal error of the airflow sensor. The airflow sensor senses airflow through the electronic smoking device and outputs a first signal indicative of the sensed airflow. The control electronics are communicatively coupled to the airflow sensor. The control electronics: monitor the first signal from the airflow sensor over a period of time, associate the first signal from the airflow sensor with a temperature-induced base-line signal of the airflow sensor where the first signal is constant for at least a threshold time period, determine the difference between the temperature-induced base-line signal and a known base-line signal of the airflow sensor at an ambient temperature, compensate for the received first signal by reducing the signal by the difference between the temperature-induced base-line signal and a known base-line signal of the airflow sensor at an ambient temperature, and operate the electronic smoking device based on the compensated first signal, indicative of the true airflow through the electronic smoking device.

In some specific embodiments of the temperature sensorless electronic smoking device, the control electronics compensate for the temperature-induced, base-line signal error of the first signal using the following equation:

$$\text{Compensated First Signal}=(\text{Actual First Signal})*((1-\text{Calibration Coefficient})*(\text{Actual First Signal}-\text{Base-line Signal}_{Ambient\ Temperature})),$$

where Base-line $\text{Signal}_{Ambient\ Temperature}$ and Calibration Coefficient are known.

The characteristics, features and advantages of this invention and the manner in which they are obtained as described above, will become more apparent and be more clearly understood in connection with the following description of example embodiments, which are explained with reference to the accompanying drawings.

The above discussion/summary is not intended to describe each embodiment or every implementation of the present disclosure. The figures and detailed description that follow also exemplify various embodiments.

BRIEF DESCRIPTION OF THE DRAWINGS

In the drawings, the same element numbers indicate the same elements in each of the views. Various example embodiments may be more completely understood in consideration of the following detailed description in connection with the accompanying drawings, in which.

Figure 1:
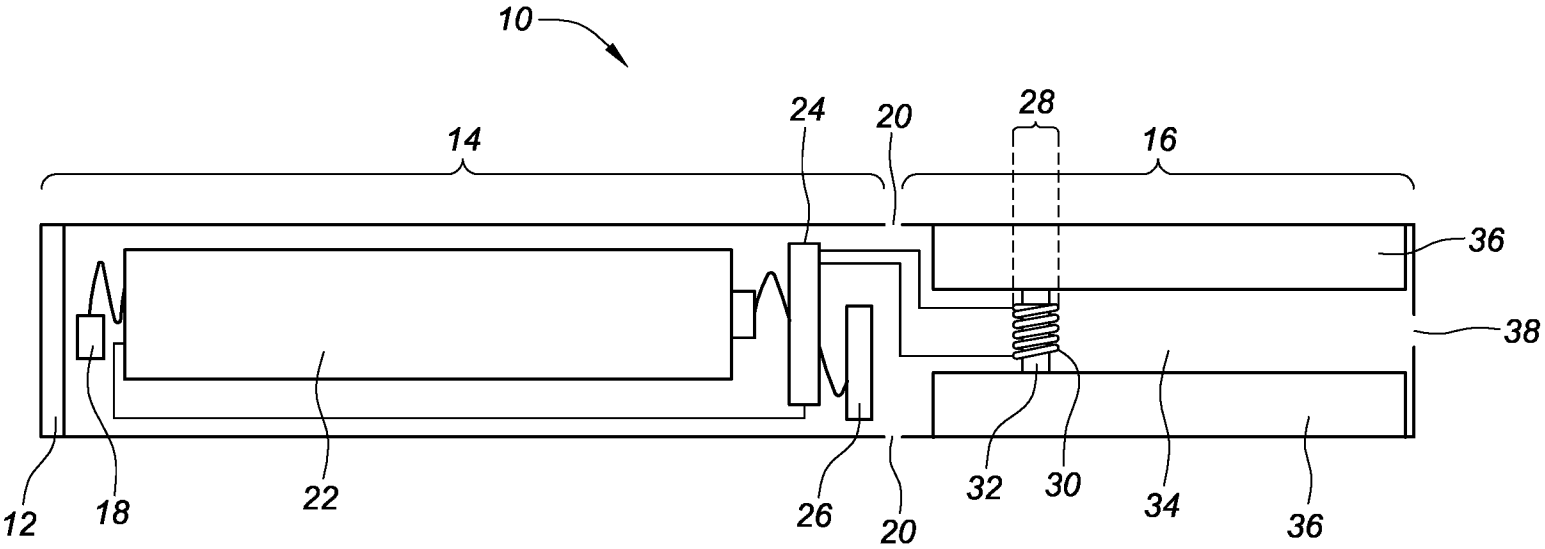
FIG. 1 is a schematic cross-sectional illustration of an example e-cigarette, consistent with various embodiments of the present disclosure.

While various embodiments discussed herein are amenable to modifications and alternative forms, aspects thereof have been shown by way of example in the drawings and will be described in detail. It should be understood, however, that the intention is not to limit the invention to the particular embodiments described. On the contrary, the intention is to cover all modifications, equivalents, and alternatives falling within the scope of the disclosure including aspects defined in the claims. In addition, the term "example" as used throughout this application is only by way of illustration, and not limitation.

DESCRIPTION OF THE PREFERRED EMBODIMENTS

Aspects of the present disclosure are directed to electronic cigarette temperature compensation.

During operation of an e-cig by a user, various components of the e-cig release heat within the e-cig causing a transient temperature state. For example, electronic circuitry within the e-cig warm-up during operation, and activation of a heating coil further warms the e-cig. External factors may also affect the temperature of the e-cig as well. For example, external ambient temperature and humidity, as well as location (e.g., within a user's pocket where the pocket insulates the e-cig from effectively dissipating heat). As a result, the e-cig must be capable of operating consistently notwithstanding transient operating temperatures.

Many e-cigs utilize flow sensors, such as a mass airflow sensor (also referred to as a MAF sensor) which detects a flow rate of air passing through the e-cig. As a MAF sensor warms-up, a base-line signal from the sensor increases. Control electronics receiving the MAF sensor signal, absent temperature related information, may interpret the increased signal strength as a flow rate increase. Where control electronics are programmed to operate the e-cig by increasing power delivery to a heater coil, in response to an increased flow rate (e.g., a strong draw by a user), the control scheme may quickly become unstable. That is, the increased power delivered to the heating coil warms the MAF sensor resulting in a heightened, base-line signal from the MAF sensor. Various embodiments of the present disclosure address this and other problems.

Aspects of the present disclosure are directed to preventing sensor drift within the e-cig related to temperature fluctuations. For example, an e-cig may include a MAF sensor which detects a user draw on the e-cig, and activates a heating coil to vaporize a liquid into a flow of air entering the user's mouth. In some embodiments, the strength of the user draw may also cause the e-cig to adjust various operational characteristics. For example, in response to a strong draw, as sensed by the MAF sensor, the heating coil may be activated for an extended period of time and/or driven with additional current. Proper operation of the e-cig may be impacted where the MAF sensor suffers from temperature-induced sensor drift. As the temperature of the MAF sensor warms-up, in response to various heat sources within the e-cig, an error-rate of the MAF sensor output signal increases in kind. Temperature-induced MAF sensor error may be caused, at least in part, by a change in base-line signal output by the MAF sensor. Aspects of the present disclosure compensate for such temperature-induced MAF sensor error by identifying temperature trends and correcting for the associated drift in the sensor signal.

Yet other aspects of the present disclosure are directed to compensating for temperature-induced signal drift associated with variable air temperature. MAF sensors may output a varying signal strength, for a given air flow, due to temperature variation. For example, cold air flow across a MAF sensor head may produce a greater signal than warm air across the sensor head. Accordingly, a temperature sensor (e.g., thermopile) may be used to sense the air temperature and compensate for the temperature-induced MAF sensor drift during signal processing at control electronics. Alternatively, or in addition thereto, a heater may be placed upwind, and in close proximity, to the MAF sensor. The heater may be activated during operation of the e-cig to facilitate a constant temperature of air flowing across the MAF sensor.

Various configurations of e-cigs utilizing temperature compensation are readily envisioned. In a first configuration, a temperature sensor may be placed in close proximity to a MAF sensor. Accordingly, when the e-cig is first activated, after a period of inactivity, the signal from the temperature sensor may be associated with an ambient temperature. After a period of activity, the signal from the temperature may be associated with a temperature of the MAF sensor. In a second configuration, the temperature sensor may be positioned within the e-cig distal from the various heat sources therein. In such an embodiment, the signal from the temperature sensor may always be associated with the ambient temperature. One limitation of the second configuration, is that temperature compensation may only be conducted for ambient temperature changes, and not for internal temperature changes associated with, for example, extended use of the e-cig.

Aspects of the present disclosure are directed toward identifying and compensating for sensor drift in an e-cig associated with internal warming of the e-cig during operation. Due to the close proximity between one or more circuit boards of the e-cig, battery, and a heating coil, extended use of the e-cig may cause the warming of one or more sensors to a temperature where a sensor output is affected by the warming (often referred to as temperature-induced sensor drift). Various sensor output base-lines may be impacted by large swings between ambient temperature and operational temperature of the e-cig. Importantly, such sensor drift, especially for flow/velocity sensors on an e-cig, may negatively impact a user experience by producing too little/much vapor.

One embodiment of the present disclosure is directed to an e-cig with a single temperature sensor, such as a thermopile. The temperature sensor detects an ambient temperature of the electronic cigarette environment, or a temperature of the air flow through the e-cig (depending upon a position of the temperature sensor within the e-cig). The output signal from the temperature sensor is provided to control electronics. The control electronics compensate for one or more of the other received sensor inputs (e.g., flow sensor) when the received temperature signal is indicative of an unacceptable signal drift of the one or more other sensors.

In a single temperature sensor e-cig embodiment, during a prolonged period of inactivity, the temperature sensor signal may be assumed to be an ambient environment temperature. During use, the sensor may be associated with an internal temperature of the ecig and its component (i.e., other sensors, such as a MAF sensor or other flow sensor).

Control electronics for a single temperature sensor e-cig configuration may monitor time since the last activation of the e-cig. Where the time since activation is less than a threshold time, the sensed temperature is indicative of a temperature of the MAF sensor. Where the time since activation exceeds the threshold time, the sensed temperature is indicative of an ambient temperature. In either case, the control electronics may compensate for the temperature-induced signal error from the MAF sensor.

Aspects of the present disclosure are also directed to an e-cig with a dual temperature sensor configuration. A first temperature sensor may be positioned distally from heat generation sources in the e-cig, and provides a first signal to control electronics indicative of an ambient temperature. A second temperature sensor is positioned in close proximity to other sensors (e.g., flow sensor) to determine the elevated temperature of the other sensors during operation, and provide a second signal to the control electronics indicative of the sensor(s) temperature. The control electronics may then use the first and second signals from the two temperature sensors to compensate for the signal drift within the signals from the other sensor(s).

Throughout the following, an electronic smoking device will be described with reference to an e-cigarette. As is shown in FIG. 1, an e-cigarette 10 typically has a housing comprising a cylindrical hollow tube having an end cap 12. The cylindrical hollow tube may be a single-piece or a multiple-piece tube. In FIG. 1, the cylindrical hollow tube is shown as a two-piece structure having a power supply portion 14 and an atomizer/liquid reservoir portion 16. Together the power supply portion 14 and the atomizer/liquid reservoir portion 16 form a cylindrical tube which can be approximately the same size and shape as a conventional cigarette, typically about 100 mm with a 7.5 mm diameter, although lengths may range from 70 to 150 or 180 mm, and diameters from 5 to 28 mm.

The power supply portion 14 and atomizer/liquid reservoir portion 16 are typically made of metal (e.g., steel or aluminum, or of hardwearing plastic) and act together with the end cap 12 to provide a housing to contain the components of the e-cigarette 10. The power supply portion 14 and the atomizer/liquid reservoir portion 16 may be configured to fit together by, for example, a friction push fit, a snap fit, a bayonet attachment, a magnetic fit, or screw threads. The end cap 12 is provided at the front end of the power supply portion 14. The end cap 12 may be made from translucent plastic or other translucent material to allow a light-emitting diode (LED) 18 positioned near the end cap to emit light through the end cap. Alternatively, the end cap may be made of metal or other materials that do not allow light to pass.

An air inlet may be provided in the end cap, at the edge of the inlet next to the cylindrical hollow tube, anywhere along the length of the cylindrical hollow tube, or at the connection of the power supply portion 14 and the atomizer/liquid reservoir portion 16. FIG. 1 shows a pair of air inlets 20 provided at the intersection between the power supply portion 14 and the atomizer/liquid reservoir portion 16.

A power supply, preferably a battery 22, the LED 18, control electronics 24 and, optionally, an airflow sensor 26 are provided within the cylindrical hollow tube power supply portion 14. The battery 22 is electrically connected to the control electronics 24, which are electrically connected to the LED 18 and the airflow sensor 26. In this example, the LED 18 is at the front end of the power supply portion 14, adjacent to the end cap 12; and the control electronics 24 and airflow sensor 26 are provided in the central cavity at the other end of the battery 22 adjacent the atomizer/liquid reservoir portion 16.

The airflow sensor 26 acts as a puff detector, detecting a user puffing or sucking on the atomizer/liquid reservoir portion 16 of the e-cigarette 10. The airflow sensor 26 can be any suitable sensor for detecting changes in airflow or air pressure, such as a microphone switch including a deformable membrane which is caused to move by variations in air pressure. Alternatively, the sensor may be, for example, a Hall element or an electro-mechanical sensor.

The control electronics 24 are also connected to an atomizer 28. In the example shown, the atomizer 28 includes a heating coil 30 which is wrapped around a wick 32 extending across a central passage 34 of the atomizer/liquid reservoir portion 16. The central passage 34 may, for example, be defined by one or more walls of the liquid reservoir and/or one or more walls of the atomizer/liquid reservoir portion 16 of the e-cigarette 10. The coil 30 may be positioned anywhere in the atomizer 28 and may be transverse or parallel to a longitudinal axis of a cylindrical liquid reservoir 36. The wick 32 and heating coil 30 do not completely block the central passage 34. Rather an air gap is provided on either side of the heating coil 30 enabling air to flow past the heating coil 30 and the wick 32. The atomizer may alternatively use other forms of heating elements, such as ceramic heaters, or fiber or mesh material heaters. Nonresistance heating elements such as sonic, piezo, and jet spray may also be used in the atomizer in place of the heating coil.

The central passage 34 is surrounded by the cylindrical liquid reservoir 36 with the ends of the wick 32 abutting or extending into the liquid reservoir 36. The wick 32 may be a porous material such as a bundle of fiberglass fibers or cotton or bamboo yarn, with liquid in the liquid reservoir 36 drawn by capillary action from the ends of the wick 32 towards the central portion of the wick 32 encircled by the heating coil 30.

The liquid reservoir 36 may alternatively include wadding (not shown in FIG. 1) soaked in liquid which encircles the central passage 34 with the ends of the wick 32 abutting the wadding. In other embodiments, the liquid reservoir may comprise a toroidal cavity arranged to be filled with liquid and with the ends of the wick 32 extending into the toroidal cavity.

An air inhalation port 38 is provided at the back end of the atomizer/liquid reservoir portion 16 remote from the end cap 12. The inhalation port 38 may be formed from the cylindrical hollow tube atomizer/liquid reservoir portion 16 or may be formed in an end cap.

In use, a user sucks on the e-cigarette 10. This causes air to be drawn into the e-cigarette 10 via one or more air inlets, such as air inlets 20, and to be drawn through the central passage 34 towards the air inhalation port 38. The change in air pressure which arises is detected by the airflow sensor 26, which generates an electrical signal that is passed to the control electronics 24. In response to the signal, the control electronics 24 activate the heating coil 30, which causes liquid present in the wick 32 to be vaporized creating an aerosol (which may comprise gaseous and liquid components) within the central passage 34. As the user continues to suck on the e-cigarette 10, this aerosol is drawn through the central passage 34 and inhaled by the user. At the same time, the control electronics 24 also activate the LED 18 causing the LED 18 to light up, which is visible via the translucent end cap 12. Activation of the LED may mimic the appearance of a glowing ember at the end of a conventional cigarette. As liquid present in the wick 32 is converted into an aerosol, more liquid is drawn into the wick 32 from the liquid reservoir 36 by capillary action and thus is available to be converted into an aerosol through subsequent activation of the heating coil 30.

Some e-cigarettes are intended to be disposable and the electric power in the battery 22 is intended to be sufficient to vaporize the liquid contained within the liquid reservoir 36, after which the e-cigarette 10 is thrown away. In other embodiments, the battery 22 is rechargeable and the liquid reservoir 36 is refillable. In the case where the liquid reservoir 36 is a toroidal cavity, this may be achieved by refilling the liquid reservoir 36 via a refill port (not shown in FIG. 1). In other embodiments, the atomizer/liquid reservoir portion 16 of the e-cigarette 10 is detachable from the power supply portion 14 and a new atomizer/liquid reservoir portion 16 can be fitted with a new liquid reservoir 36 thereby replenishing the supply of liquid. In some cases, replacing the liquid reservoir 36 may involve replacement of the heating coil 30 and the wick 32 along with the replacement of the liquid reservoir 36. A replaceable unit comprising the atomizer 28 and the liquid reservoir 36 may be referred to as a cartomizer.

The new liquid reservoir may be in the form of a cartridge (not shown in FIG. 1) defining a passage (or multiple passages) through which a user inhales aerosol. In other embodiments, the aerosol may flow around the exterior of the cartridge to the air inhalation port 38.

Of course, in addition to the above description of the structure and function of a typical e-cigarette 10, variations also exist. For example, the LED 18 may be omitted. The airflow sensor 26 may be placed, for example, adjacent to the end cap 12 rather than in the middle of the e-cigarette. The airflow sensor 26 may be replaced by, or supplemented with, a switch which enables a user to activate the e-cigarette manually rather than in response to the detection of a change in air flow or air pressure.

Different types of atomizers may be used. Thus, for example, the atomizer may have a heating coil in a cavity in the interior of a porous body soaked in liquid. In this design, aerosol is generated by evaporating the liquid within the porous body either by activation of the coil heating the porous body or alternatively by the heated air passing over or through the porous body. Alternatively, the atomizer may use a piezoelectric atomizer to create an aerosol either in combination or in the absence of a heater.

Figure 2:
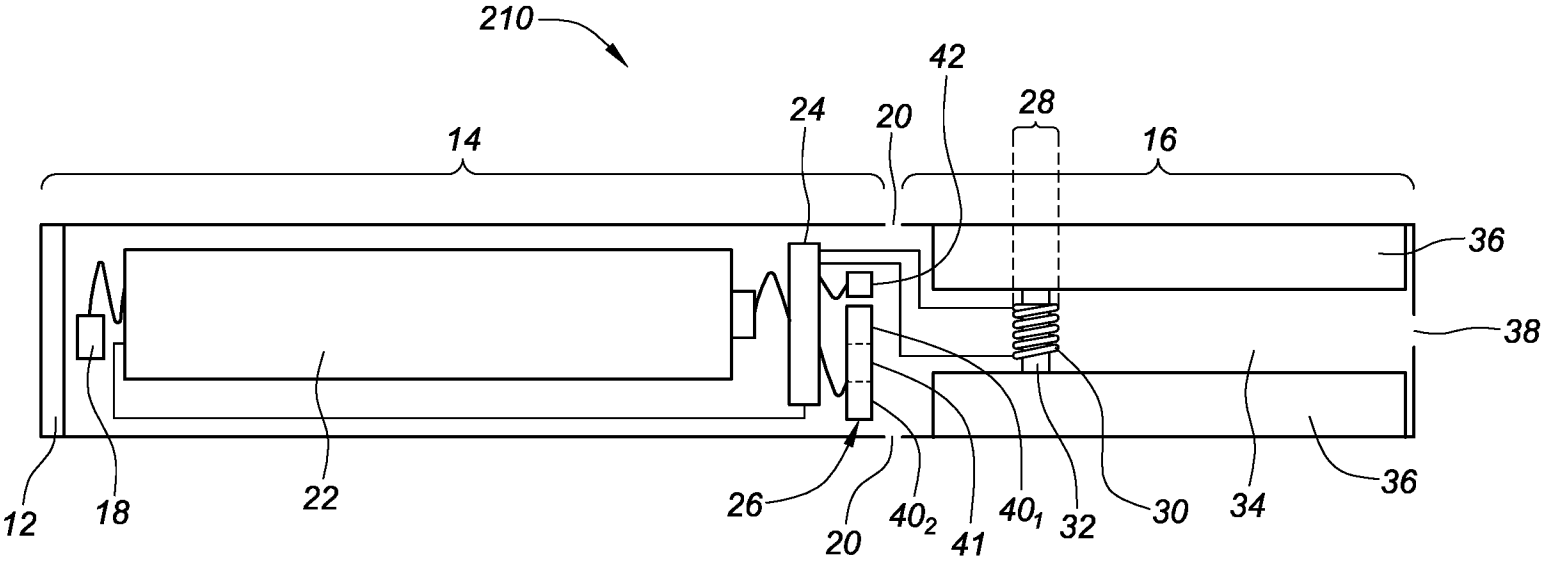
FIG. 2 is a schematic cross-sectional illustration of an example e-cigarette, consistent with various embodiments of the present disclosure.

FIG. 2 is a schematic, cross-sectional illustration of an e-cigarette 210, consistent with various embodiments of the present disclosure. As is shown in FIG. 2, the e-cigarette 210 has a housing comprising a two-piece structure. The two-piece structure includes a power supply portion 14 and an atomizer/liquid reservoir portion 16. The power supply portion 14 and the atomizer/liquid reservoir portion 16 may be releasably coupled to one another. The end cap 12 is provided at the front end of the power supply portion 14. The end cap 12 may be translucent to allow a light-emitting diode (LED) 18 positioned near the end cap to emit light there through.

A power supply, such as a battery 22, the LED 18, control electronics 24, and an airflow sensor 26 are provided within the power supply portion 14. The battery 22 is electrically connected to the control electronics 24, which are electrically connected to the LED 18 and the airflow sensor 26.

Air inlets 20 are provided at the connection of the power supply portion 14 and the atomizer/liquid reservoir portion 16. To operate the e-cigarette, a user may draw from the air inhalation port 38. The air inhalation port 38 is provided at the back end of the atomizer/liquid reservoir portion 16. The user draw creates a vacuum pressure within the atomizer/liquid reservoir portion 16 which draws air into the e-cigarette via the air inlets 20. The airflow sensor 26 acts as a puff detector, detecting the user draw on the air inhalation port 38. The airflow sensor 26 may be any suitable sensor for detecting changes in airflow or air pressure. Various embodiments of the present disclosure will be disclosed and discussed in reference to the airflow sensor 26 being a mass air flow sensor, and more specifically a membrane-type MAF sensor.

The MAF sensor 26 comprises a thin electronic membrane placed in the air stream which travels through central passage 34 between the air inlets 20 and the air inhalation port 38. The MAF sensor membrane includes a first thin film temperature sensor $\mathbf{40}_1$ printed on the upstream side, and a second thin film temperature sensor $\mathbf{40}_2$ printed on a downstream side. A heater 41 is integrated in the center of the membrane, and maintains a constant temperature. Without any airflow, the temperature profile across the MAF sensor membrane is uniform. When air flows across the membrane, the first thin film temperature sensor $\mathbf{40}_1$ cools more than the second thin film temperature sensor $\mathbf{40}_2$ which is downstream of the heater 41. The difference between the upstream and downstream temperature is indicative of the mass airflow through the central passage 34. The MAF sensor is communicatively coupled to the control electronics 24 and transmits a signal thereto indicative of the air flow sensed.

The control electronics 24 are also electrically coupled to an atomizer 28. In the embodiment of FIG. 2, the atomizer 28 includes a heating coil 30 which is wrapped around a wick 32 extending across a central passage 34 of the atomizer/liquid reservoir portion 16. The central passage 34 may, for example, be defined by one or more walls of the liquid reservoir and/or one or more walls of the atomizer/liquid reservoir portion 16 of the e-cigarette 210. The central passage 34 is surrounded by the cylindrical liquid reservoir 36 with the ends of the wick 32 abutting or extending into the liquid reservoir 36. The wick 32 may be a porous material with liquid in the liquid reservoir 36 drawn by capillary action from the ends of the wick 32 towards the central portion of the wick 32 encircled by the heating coil 30.

Upon receiving a signal from the MAF sensor 26, which exceeds a threshold indicative of a user puff, the control electronics 24 may energize heating coil 30. The energy traveling through the heating coil 30 warms the coil and the liquid within the wick 32 which encircles the coil, vaporizing the liquid into the air stream flowing toward air inhalation port 38.

Further aspects of the embodiment disclosed in FIG. 2 are directed to a temperature sensor 42 which is communicatively coupled to control electronics 24, and is positioned upstream of the airflow sensor 26. As the airflow sensor 26 includes a heater 41 (and is further subjected to heat from battery 22, control electronics 24, and heating coil 30), extended usage of the e-cig may cause the airflow sensor 26 to succumb to temperature-induced signal drift. Accordingly, aspects of the present disclosure are directed to airflow sensor signal-drift identification and compensation.

The control electronics 24, after a period of inactivity of the e-cig, may associate a temperature received from the temperature sensor 42 as an ambient temperature. However, when the e-cigarette is being operated or in close temporal proximity of operation, the control electronics 24 associates the temperature received from the temperature sensor 42 with an internal temperature of the e-cigarette. Based on the temperature information received from the temperature sensor 42, the control electronics 24 may conduct compensation of a signal received from the airflow sensor 26. Specifically, where an internal temperature of the e-cigarette exceeds a threshold, the base-line signal of the airflow sensor may be compromised resulting in an unacceptable error rate for the resulting airflow determination through the e-cigarette. Based on the determined temperature within the e-cigarette, the control electronics may compensate for the base-line signal error. After conducting base-line signal error compensation, the control electronics may more accurately determine the air flow through the central passage 34, and respond properly to the changes in the air flow during periods of extended operation, and/or excessive temperature environments.

Figure 3:
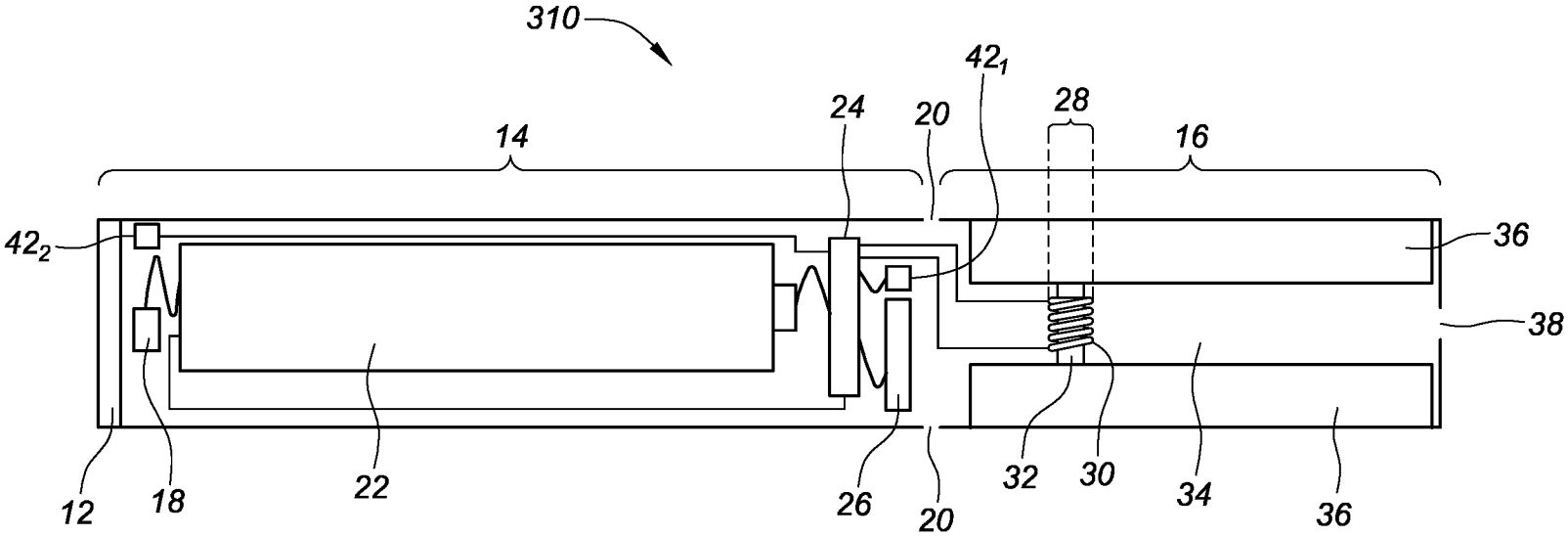
FIG. 3 is a schematic cross-sectional illustration of an example e-cigarette, consistent with various embodiments of the present disclosure.

FIG. 3 is a schematic cross-sectional illustration of an example e-cigarette 310, consistent with various embodiments of the present disclosure. As is shown in FIG. 3, the e-cigarette 310 typically has a housing comprising a two-piece structure. The two-piece structure includes a power supply portion 14 and an atomizer/liquid reservoir portion 16. The power supply portion 14 and the atomizer/liquid reservoir portion 16 may be coupled to one another. The end cap 12 is provided at the front end of the power supply portion 14. The end cap 12 may be translucent to allow a light-emitting diode (LED) 18 positioned near the end cap to emit light there through.

A power supply, such as a battery 22, the LED 18, control electronics 24, and an airflow sensor 26 are provided within the power supply portion 14. The battery 22 is electrically connected to the control electronics 24, which is electrically connected to the LED 18 and the airflow sensor 26.

Air inlets 20 are provided at the connection of the power supply portion 14 and the atomizer/liquid reservoir portion 16. To operate the e-cigarette, a user may draw from the air inhalation port 38. The air inhalation port 38 is provided at the back end of the atomizer/liquid reservoir portion 16 remote from the end cap 12. The user draw creates a vacuum pressure within the atomizer/liquid reservoir portion 16 which draws air into the e-cigarette via the air inlets 20. The airflow sensor 26 acts as a puff detector, detecting the user draw on the air inhalation port 38.

The airflow sensor 26 is communicatively coupled to the control electronics 24 and transmits a signal thereto indicative of the air flow sensed passing through central passage 34. The control electronics 24 are also electrically coupled to an atomizer 28.

As shown in FIG. 3, the atomizer 28 includes a heating coil 30 which is wrapped around a wick 32 extending across a central passage 34 of the atomizer/liquid reservoir portion 16. The central passage 34 may, for example, be defined by one or more walls of the liquid reservoir and/or one or more walls of the atomizer/liquid reservoir portion 16 of the e-cigarette 310. The central passage 34 is surrounded by the cylindrical liquid reservoir 36 with the ends of the wick 32 abutting or extending into the liquid reservoir 36. The wick 32 may be a porous material with liquid in the liquid reservoir 36 drawn by capillary action from the ends of the wick 32 towards the central portion of the wick 32 encircled by the heating coil 30.

Upon receiving a signal from the airflow sensor 26, which exceeds a threshold indicative of a user puff, the control electronics 24 may energize heating coil 30. The energy traveling through the heating coil 30 warms the coil and the liquid within the wick 32, which encircles the coil, and vaporizes the liquid into the air stream flowing through central passage 34 toward air inhalation port 38.

Aspects of the embodiment disclosed in FIG. 3 are directed to a dual-temperature sensor configuration which may facilitate operational signal compensation associated with elevated ambient temperature and/or elevated internal e-cigarette temperature. Elevated internal e-cig temperature may be caused by, for example, extended operation of the e-cig. A first temperature sensor $\mathbf{42}_1$ and second temperature sensor $\mathbf{42}_2$ are communicatively coupled to control electronics 24. The first temperature sensor $\mathbf{42}_1$ may be positioned in proximity to the control electronics, an airflow sensor 26, among other heat dissipating elements of the e-cigarette (e.g., battery 22, and heating coil 30). The second temperature sensor $\mathbf{42}_2$ may be placed within the e-cig 310, and located distal from the various heat dissipating elements. As a result, the first temperature sensor may communicate a first signal to the control electronics indicative of an internal operating temperature of the e-cig, and the second temperature sensor may communicate a second signal to the control electronics indicative of an ambient temperature in which the e-cig is operating.

Airflow sensor 26 may be susceptible to variability in a base-line signal due to the sensor's operating temperature. Varying temperature during operation of the e-cig may result in temperature-induced error in the airflow signal received by control electronics 24. This measured airflow error rate, in many applications, may result in the e-cig operating outside of designated parameters. For example, higher temperature airflow may cause a signal output from the airflow sensor indicative of a higher airflow than experienced within the central passage 34. The control electronics may then increase power delivered to atomizer 28 to maintain a consistent delivery of nicotine per volume of air. However, due to the error rate of the airflow sensor, the control electronics (sans signal compensation) will unintentionally be increasing the nicotine delivery per volume of air. This may result in an undesirable taste experience for the user. Aspects of the present disclosure are directed to identifying temperature-induced sensor error, and compensation thereof by control electronics 24.

Based on the temperature information received from first and second temperature sensors $\mathbf{42}_{1\text{-}2}$, control electronics 24 may conduct compensation of a signal received from the airflow sensor 26. Specifically, where an internal temperature of the e-cigarette exceeds a threshold, the base-line signal of the airflow sensor may be compromised resulting in an unacceptable error rate for the resulting airflow determination through central passage 34. Based on the determined temperature within the e-cigarette, the control electronics may compensate for the base-line signal error of the airflow sensor. As a result, the control electronics may more accurately assess air flow through the central passage 34, and respond only to true changes in the air flow.

In one implementation of the dual-temperature sensor embodiment of FIG. 3, control electronics 24 may sample a second temperature sensor signal from second temperature sensor $\mathbf{42}_2$, which is located at a distal end of power supply portion 14. The control electronics associate the second temperature sensor signal with an ambient environment temperature. Where the second temperature sensor signal is indicative of an elevated temperature environment, control electronics may implement a second temperature compensation algorithm on the airflow sensor signal to compensate for the base-line signal error of the airflow sensor 26. Similarly, where the difference between temperatures sensed by a first temperature sensor $\mathbf{42}_1$ and a second temperature sensor $\mathbf{42}_2$ exceeds a threshold, the e-cigarette is experiencing substantial internal heating, often associated with prolonged operation. In response, the control electronics 24 may implement a first temperature compensation algorithm on the airflow sensor signal to compensate for the base-line signal error of the airflow sensor 26. In some implementations, the first and second temperature compensation algorithms may be the same, or may vary depending upon the extent of compensation required for each of the unique situations. For example, during extended operation of the e-cig, the temperature experienced by the airflow sensor may far exceed any possible elevated ambient temperature environments. Moreover, the base-line signal error may not be linear relative to temperature, thereby requiring various compensation schemes for different temperature ranges.

Some embodiments of the present disclosure are directed to temperature-based signal correction of an airflow sensor without adding temperature sensors to the e-cigarette. The airflow sensor has a static signal value (or baseline signal) that varies with a temperature change experienced by the airflow sensor. For example, an increase in ambient temperature causes an increase in the static signal value of the airflow sensor, where an airflow experienced by the airflow sensor is static. In such an embodiment, during manufacturing/calibration the static signal value of the airflow sensor over a range of temperatures may be determined. Accordingly, during operation control electronics of the e-cigarette may determine an airflow sensor temperature based on the sensed static signal value when the e-cig is not experiencing a user draw (e.g., no airflow past the airflow sensor). The control electronics associates an increased signal value with a temperature increase as opposed to a user draw when the increased signal value exceeds a threshold time beyond that of a typical user draw. The control electronics may compensate for the elevated static signal value by removing the portion of the signal associated with the elevated temperature. When the system experiences a user draw, the compensated signal has an improved signal to noise ratio. In such an embodiment, an elevated temperature of the airflow sensor will not result in a false reading of airflow through the e-cigarette and/or an airflow reading that exceeds the actual airflow. Moreover, in some more specific embodiments, the control electronics may also compensate for a sensitivity change of the airflow sensor associated with temperature fluctuations. During testing, sensitivity changes of the airflow sensor may be measured over a range of temperatures (and may be extrapolated where necessary to ranges which exceed a tested range). When the airflow sensor senses an airflow outside of ideal operating temperature ranges (e.g., room temperature), the control electronics will compensate for the temperature-affected static signal value. Based on the change in the baseline signal received from the control electronics from the airflow sensor, an approximate temperature of the airflow sensor may be determined by virtue of the testing/calibration step. The control electronics may further compensate for the sensor sensitivity changes associated with that temperature as well when an airflow is detected.

Specific/Experimental Embodiments

One specific/experimental embodiment of the present disclosure is directed to an e-cigarette including an airflow sensor for detecting a flow of air through the e-cigarette and two temperature sensors. The first temperature sensor placed in proximity to the airflow sensor to determine the relative temperature of the airflow sensor in response to various thermal inputs, and a second temperature sensor placed distal from the various thermal inputs within the e-cigarette. The second temperature sensor being indicative of an ambient temperature in which the e-cigarette is operating.

Control electronics within the e-cigarette are communicatively coupled to the airflow sensor, and first and second temperature sensors. The control electronics compensate for effects of temperature variation on the airflow sensor accuracy using a signal compensation algorithm. While the present embodiment presents one specific compensation algorithm, a skilled artisan will appreciate that various modifications to the present algorithm are readily envisioned, and implemented in view of the disclosure presented herein. The compensation algorithm determines an Effective Airflow Sensor Signal ("EASS"), or compensated signal, which compensates for the effects of temperature variations on the airflow sensor.

$$\text{EASS}=(\text{Actual Airflow Sensor Signal})*((1-\text{Calibration Coefficient})*(T_{Airflow\ Sensor}-T_{Ambient}))-\text{Ambient Coefficient}*|T_{Ambient}-T_{Calibration}| \quad \text{Equation 1:}$$

Some alternative embodiments may utilize a variation on Equation 1, as presented below:

$$\text{EASS}=(\text{Actual Airflow Sensor Signal})*((1-\text{Calibration Coefficient})*(T_{Airflow\ Sensor}-T_{Ambient}))-\text{Ambient Coefficient}*|T_{Ambient}-T_{Calibration}|^2 \quad \text{Equation 2:}$$

The resulting e-cigarette system, utilizing Eq. 1, Eq. 2, or some variation thereof, may operate in elevated or reduced temperature environments without airflow sensor error affecting the overall performance of the e-cigarette.

One embodiment of the present disclosure is directed to an electronic smoking device including an airflow sensor, a temperature sensor, and control electronics. The airflow sensor senses airflow through the electronic smoking device and outputs a first signal indicative of the sensed airflow. The temperature sensor senses a temperature and outputs a second signal indicative of the sensed temperature. The control electronics are communicatively coupled to the airflow sensor and the temperature sensor. The control electronics receive the first and second signals, and based on the received second signal compensate for a temperature-induced airflow sensor signal error of the first signal. The control electronics operate the electronic smoking device based on the compensated first signal, which is indicative of the true airflow through the electronic smoking device.

In more specific embodiments, the electronic smoking device may further include a central passage that facilitates airflow through the electronic smoking device, a liquid reservoir that stores e-cigarette liquid, a heating coil communicatively coupled with the control electronics and positioned within the central passage, and a wick placed in fluid communication between the liquid reservoir and the heating coil. The wick draws the e-cigarette liquid within the liquid reservoir to the heating coil via capillary action. The control electronics, in response to the compensated first signal being indicative of the airflow through the electronic smoking device, drive the heating coil with a current that causes the e-cigarette liquid on the heating coil to vaporize into the airflow. Further, the control electronics maintain a constant density of vapor per unit volume of airflow in response to a change in the volumetric flow rate by varying the current to the heating coil based on the compensated first signal.

In some embodiments the electronic smoking device, the second signal is indicative of an ambient temperature around the electronic smoking device. The control electronics associate the second signal from the temperature sensor with the ambient temperature when a standby time of the electronic smoking device exceeds a threshold time; and where the sensed ambient temperature is elevated, corrects the base-line signal of the first signal to compensate for the temperature-induced, base-line signal error associated with the elevated ambient temperature.

An electronic smoking device, consistent with the present disclosure, where a sensed temperature of the temperature sensor is indicative of an elevated temperature of the electronic smoking device associated with operation of the electronic smoking device. The control electronics associate the second signal from the temperature sensor with the elevated temperature of the electronic smoking device when a standby time of the electronic smoking device is less than a threshold time; and in response to the elevated temperature, corrects the base-line signal of the first signal to compensate for the temperature-induced, base-line signal error associated with the elevated electronic smoking device temperature.

Aspects of the present disclosure are directed to an electronic smoking device, wherein the airflow sensor is a membrane-type mass airflow sensor includes a first thin film temperature sensor, a second thin film temperature sensor, and a heater. The first thin film temperature sensor is printed on an upstream side of the mass airflow sensor. The second thin film temperature sensor is printed on a downstream side of the mass airflow sensor. The heater is positioned between the first and the second thin film temperature sensors. The heater maintains a constant mass airflow sensor temperature. The airflow sensor, without any airflow, produces a temperature profile across the sensor membrane that is substantially uniform, indicating no airflow across the sensor membrane. When air flows across the sensor, the first thin film temperature sensor cools more than the second thin film temperature sensor which is downstream of the heater, the extent of the temperature differential is indicative of the airflow velocity across the sensor membrane.

In some embodiments of the electronic smoking device of claim 1, the control electronics compensate for the temperature-induced, base-line signal error of the first signal using the following equation:

$$\text{Compensated First Signal}=(\text{Actual First Signal})*((1-\text{Calibration Coefficient})*(T_{Airflow\ Sensor}-T_{Ambient}))-\text{Ambient Coefficient}*|T_{Ambient}-T_{Calibration}|,$$

where $T_{Ambient}$, $T_{Calibration}$, Calibration Coefficient, and Ambient Coefficient are known, and $T_{Airflow\ Sensor}$ is determined based on the received second signal.

Various embodiments of the present disclosure are directed to an electronic smoking device including an airflow sensor, first and second temperature sensors, and control electronics. The airflow sensor senses airflow through the electronic smoking device and outputs a first signal indicative of the sensed airflow. The first temperature sensor senses an ambient temperature and outputs a second signal indicative of the sensed ambient temperature. The second temperature sensor senses an internal temperature of the electronic smoking device and outputs a third signal indicative of the sensed internal temperature. The control electronics are communicatively coupled to the airflow sensor and the first and second temperature sensors. The control electronics receive the first, second, and third signals, and based on the received second and third signals, determine the difference in temperature between the ambient temperature and the internal temperature of the electronic smoking device. The control electronics further, based on the difference in temperature, compensate for a temperature-induced airflow sensor signal error of the first signal from the airflow sensor, and operate the electronic smoking device based on the compensated first signal indicative of the true airflow through the electronic smoking device.

In some specific embodiments of the present disclosure, the control electronics associate a second signal from the first temperature sensor with an elevated ambient temperature when the second signal is indicative of an ambient temperature exceeding a threshold ambient temperature. When the sensed ambient temperature is elevated, the control electronics correct the base-line signal of the first signal to compensate for the temperature-induced, base-line signal error associated with the elevated ambient temperature.

In yet further embodiments of the present disclosure, the control electronics associate a third signal from a second temperature sensor with the elevated temperature of the electronic smoking device when the third signal is indicative of an internal temperature of the electronic smoking device which exceeds a threshold temperature. The control electronics, in response to the elevated temperature of the electronic smoking device, correct the base-line signal of the first signal to compensate for the temperature-induced, base-line signal error associated with the elevated electronic smoking device temperature.

The control electronics, consistent with the present disclosure, may compensate for the temperature-induced, base-line signal error of the first signal using the following equation:

$$\text{Compensated First Signal}=(\text{Actual First Signal})*((1-\text{Calibration Coefficient})*(T_{Airflow\ Sensor}-T_{Ambient}))-\text{Ambient Coefficient}*|T_{Ambient}-T_{Calibration}|,$$

where $T_{Calibration}$, Calibration Coefficient, and Ambient Coefficient are known, $T_{Airflow\ Sensor}$ is determined based on the received third signal, and $T_{Ambient}$ is determined based on the received second signal.

In other embodiments, the control electronics may compensate for the temperature-induced, base-line signal error of the first signal using the following equation:

$$\text{Compensated First Signal}=(\text{Actual First Signal})*((1-\text{Calibration Coefficient})*(T_{Airflow\ Sensor}-T_{Ambient}))-\text{Ambient Coefficient}*|T_{Ambient}-T_{Calibration}|^2,$$

where $T_{Calibration}$, Calibration Coefficient, and Ambient Coefficient are known, $T_{Airflow\ Sensor}$ is determined based on the received second signal, and $T_{Ambient}$ is determined based on the received second signal.

Other embodiments, consistent with the present disclosure, are directed to a an electronic smoking device including an airflow sensor, and control electronics. Aspects of the present disclosure do not require temperature sensors to facilitate the identification of temperature-induced signal error of the airflow sensor. The airflow sensor senses airflow through the electronic smoking device and outputs a first signal indicative of the sensed airflow. The control electronics are communicatively coupled to the airflow sensor. The control electronics: monitor the first signal from the airflow sensor over a period of time, associate the first signal from the airflow sensor with a temperature-induced base-line signal of the airflow sensor where the first signal is constant for at least a threshold time period, determine the difference between the temperature-induced base-line signal and a known base-line signal of the airflow sensor at an ambient temperature, compensate for the received first signal by reducing the signal by the difference between the temperature-induced base-line signal and a known base-line signal of the airflow sensor at an ambient temperature, and operate the electronic smoking device based on the compensated first signal, indicative of the true airflow through the electronic smoking device.

In some specific embodiments of the temperature sensorless electronic smoking device, the control electronics compensate for the temperature-induced, base-line signal error of the first signal using the following equation:

$$\text{Compensated First Signal}=(\text{Actual First Signal})*((1-\text{Calibration Coefficient})*(\text{Actual First Signal}-\text{Base-line Signal}_{Ambient\ Temperature})),$$

where Base-line $\text{Signal}_{Ambient\ Temperature}$ and Calibration Coefficient are known.

While this invention has been described in connection with what is presently considered to be practical exemplary embodiments, it is to be understood that the invention is not limited to the disclosed embodiments, but, on the contrary, is intended to cover various modifications and equivalent arrangements included within the scope of the appended claims. Changes in detail or structure may be made without departing from the present teachings. The foregoing description and following claims are intended to cover all such modifications and variations.

Various embodiments are described herein of various apparatuses, systems, and methods. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments, the scope of which is defined solely by the appended claims.

Reference throughout the specification to "various embodiments," "some embodiments," "one embodiment," "an embodiment," or the like, means that a particular feature, structure, or characteristic described in connection with the embodiment is included in at least one embodiment. Thus, appearances of the phrases "in various embodiments," "in some embodiments," "in one embodiment," "in an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features structures, or characteristics of one or more other embodiments without limitation.

Any patent, publication, or other disclosure material, in whole or in part, that is said to be incorporated by reference herein is incorporated herein only to the extent that the incorporated materials does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Various modules or other circuits may be implemented to carry out one or more of the operations and activities described herein and/or shown in the figures. In these contexts, a "module" is a circuit that carries out one or more of these or related operations/activities (e.g., control electronics). For example, in certain of the above-discussed embodiments, one or more modules are discrete logic circuits or programmable logic circuits configured and arranged for implementing these operations/activities. In certain embodiments, such a programmable circuit is one or more computer circuits programmed to execute a set (or sets) of instructions (and/or configuration data). The instructions (and/or configuration data) can be in the form of firmware or software stored in and accessible from a memory (circuit). As an example, first and second modules include a combination of a CPU hardware-based circuit and a set of instructions in the form of firmware, where the first module includes a first CPU hardware circuit with one set of instructions and the second module includes a second CPU hardware circuit with another set of instructions.

Certain embodiments are directed to a computer program product (e.g., nonvolatile memory device), which includes a machine or computer-readable medium having stored thereon instructions which may be executed by a computer (or other electronic device) to perform these operations/activities.

LIST OF REFERENCE SIGNS

10/210/310 electronic smoking device
12 end cap
14 power supply portion
16 atomizer/liquid reservoir portion
18 light-emitting diode (LED)
20 air inlets
22 battery
24 control electronics
26 airflow sensor
28 atomizer
30 heating coil
32 wick
34 central passage
36 liquid reservoir
38 air inhalation port
40 thin film temperature sensor
41 heater
42 temperature sensor

The invention claimed is:

1. An electronic smoking device comprising:

an airflow sensor configured and arranged to sense airflow through the electronic smoking device and output a first signal indicative of the sensed airflow;

a temperature sensor configured and arranged to sense a temperature and output a second signal indicative of the sensed temperature; and control electronics communicatively coupled to the airflow sensor and the temperature sensor, the control electronics configured and arranged to receive the first and second signals, based on the received second signal, compensate for a temperature-induced airflow sensor signal error of the first signal, and operate the electronic smoking device based on the compensated first signal, which is indicative of the true airflow through the electronic smoking device;

wherein the control electronics are further configured and arranged to compensate for the temperature-induced, base-line signal error of the first signal using the following equation:

$$\text{Compensated First Signal}=(\text{Actual First Signal})*((1-\text{Calibration Coefficient})*(T_{Airflow\ Sensor}-T_{Ambient}))-\text{Ambient Coefficient}*|T_{Ambient}-T_{Calibration}|,$$

where $T_{Ambient}$, $T_{Calibration}$, Calibration Coefficient, and Ambient Coefficient are known, and $T_{Airflow\ sensor}$ is determined based on the received second signal.

2. The electronic smoking device of claim 1, further including a central passage configured and arranged to facilitate airflow through the electronic smoking device, a liquid reservoir configured and arranged to store an electronic cigarette liquid, a heating coil communicatively coupled with the control electronics and positioned within the central passage, and a wick placed in fluid communication between the liquid reservoir and the heating coil, and configured and arranged to draw the electronic cigarette liquid within the liquid reservoir to the heating coil via capillary action; and wherein the control electronics are further configured and arranged to in response to the compensated first signal being indicative of the airflow through the electronic smoking device, drive the heating coil with a current that causes the electronic cigarette liquid on the heating coil to vaporize into the airflow, and maintain a constant density of vapor per unit volume of airflow in response to a change in the volumetric flow rate by varying the current to the heating coil based on the compensated first signal.

3. The electronic smoking device of claim 1, wherein the second signal is indicative of an ambient temperature around the electronic smoking device; the control electronics are further configured and arranged to associate the second signal from the temperature sensor with the ambient temperature when a standby time of the electronic smoking device exceeds a threshold time, and where the sensed ambient temperature is elevated, correct a base-line of the first signal to compensate for the temperature-induced, base-line signal error associated with the elevated ambient temperature.

4. An electronic smoking device comprising:

an airflow sensor configured and arranged to sense airflow through the electronic smoking device and output a first signal indicative of the sensed airflow;

a temperature sensor configured and arranged to sense a temperature and output a second signal indicative of the sensed temperature; and control electronics communicatively coupled to the airflow sensor and the temperature sensor, the control electronics configured and arranged to receive the first and second signals, based on the received second signal, compensate for a temperature-induced airflow sensor signal error of the first signal, and operate the electronic smoking device based on the compensated first signal, which is indicative of a true airflow through the electronic smoking device;

wherein the sensed temperature of the temperature sensor is indicative of an elevated temperature of the electronic smoking device associated with operation of the electronic smoking device; the control electronics are further configured and arranged to associate the second signal from the temperature sensor with the elevated temperature of the electronic smoking device when a standby time of the electronic smoking device is less than a threshold time, and in response to the elevated temperature, correct a base-line signal of the first signal to compensate for a temperature-induced, base-line signal error associated with the elevated electronic smoking device temperature.

5. An electronic smoking device comprising:

an airflow sensor configured and arranged to sense airflow through the electronic smoking device and output a first signal indicative of the sensed airflow;

a temperature sensor configured and arranged to sense a temperature and output a second signal indicative of the sensed temperature; and control electronics communicatively coupled to the airflow sensor and the temperature sensor, the control electronics configured and arranged to receive the first and second signals, based on the received second signal, compensate for a temperature-induced airflow sensor signal error of the first signal, and operate the electronic smoking device based on the compensated first signal, which is indicative of a true airflow through the electronic smoking device;

wherein the airflow sensor is a membrane-type mass airflow sensor including a first thin film temperature sensor printed on an upstream side of the mass airflow sensor, a second thin film temperature sensor printed on a downstream side of the mass airflow sensor, and a heater positioned between the first and the second thin film temperature sensors, the heater configured and arranged to maintain a constant mass airflow sensor temperature, the airflow sensor is configured and arranged without any airflow, to produce a temperature profile across the sensor membrane is substantially uniform, indicating no airflow across the sensor membrane, and with air flow across the sensor, to cool the first thin film temperature sensor more than the second thin film temperature sensor which is downstream of the heater, the extent of the temperature differential being indicative of the airflow velocity across the sensor membrane.

* * * * *